US006148574A

United States Patent [19]

Chapman

[11] Patent Number: 6,148,574

[45] Date of Patent: Nov. 21, 2000

[54] ROOFING FOR BUILDINGS

[75] Inventor: Leslie Chapman, Alton, United Kingdom

[73] Assignee: KHS Group Limited, United Kingdom

[21] Appl. No.: 09/180,047

[22] PCT Filed: May 1, 1997

[86] PCT No.: PCT/GB97/01203

§ 371 Date: Oct. 29, 1998

§ 102(e) Date: Oct. 29, 1998

[87] PCT Pub. No.: WO97/42381

PCT Pub. Date: Nov. 13, 1997

[30] Foreign Application Priority Data

May 2, 1996 [GB] United Kingdom ..... 9609210

[51] Int. Cl.[7] ..... E04B 1/00

[52] U.S. Cl. ..... 52/289; 52/639; 52/702

[58] Field of Search ..... 52/251–260, 289, 52/639–644, 647, 651.07, 702

[56] References Cited

U.S. PATENT DOCUMENTS

| | | | |
|---|---|---|---|
| 741,066 | 10/1903 | O'Shea | 52/702 X |
| 1,078,306 | 11/1913 | Ostrander | 52/639 |
| 1,097,934 | 5/1914 | Price | 52/702 X |
| 1,538,218 | 5/1925 | Steelye | 52/702 X |
| 1,651,516 | 12/1927 | Ellis | 52/289 X |
| 2,137,009 | 11/1938 | Stromberg | 52/702 X |
| 2,994,415 | 8/1961 | Halle | 52/702 X |
| 3,019,861 | 2/1962 | Rash et al. | 52/639 |
| 3,196,996 | 7/1965 | De La Rambeljle | 52/702 X |
| 3,358,848 | 12/1967 | Johnsson | 52/702 X |
| 4,691,137 | 9/1987 | Schleich | 52/251 |

*Primary Examiner*—Richard Chilcot

*Attorney, Agent, or Firm*—Amster, Rothstein & Ebenstein

[57] ABSTRACT

A roofing truss (3) has an end plate (10) for engagement against a flange (1*a*) of a supporting I-beam (1). To aid assembly of the truss and I-beam and to locate the same after assembly the upper end of the plate (10) carries on the surface to face the I-beam a bifurcated guide means (11, 12) arranged to extend over the upper portions of the flange (1*a*) and to engage on either side of a central web (1*b*) of the I-beam (1).

5 Claims, 3 Drawing Sheets

ROOFING FOR BUILDINGS

Figure 1:
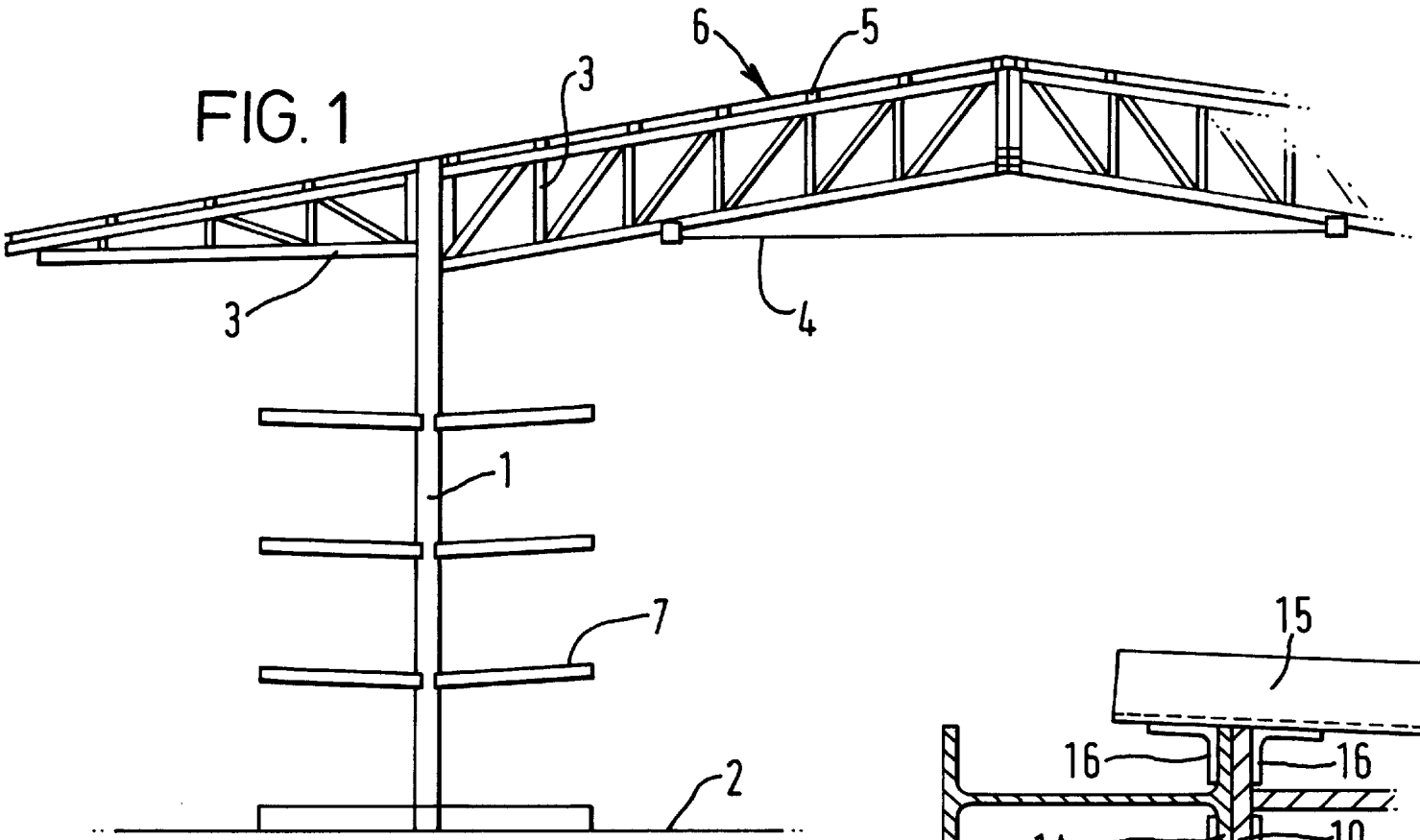

The invention concerns improvements in and relating to roofing for buildings, and, more especially, to an improved connecting means for use in the assembly of a building roof from prefabricated components of metal, e.g. steel.

In the construction of prefabricated metal buildings for example for storage and warehousing purposes, a storage area may be provided with a supported roof that does not rely upon external walls of the building for its support. Thus the sides of the building may be left open for access, or may be closed by means of simple, non load-bearing walls. In such a construction, for example, vertical I-beams of rolled steel may serve as columns for supporting the roof via trusses bolted to the flanges of the I-beams at the upper ends thereof. Purlins carried by the roof trusses will then support the roof cladding.

Such an arrangement is particularly useful for storage purposes, since the vertical I-beams may also serve as supports for cantilever racking of known construction.

However, the assembly of such a building construction is complicated by the requirement for the roof trusses to be bolted to the upper ends of the vertical I-beams. The relatively massive trusses must be manoeuvred into position with their ends abutting the flanges of the I-beams in the appropriate position for the assembly of connecting bolts. The trusses must be lifted by a hoist and accurate manual location of the ends of the trusses swung from a hoist can prove difficult, particularly in adverse weather conditions.

It is accordingly an object of the invention to provide means enabling simplification of the process of assembly of such a construction.

In accordance with the invention there is provided a roofing truss for assembly to the upper end of a vertical I-beam, the truss comprising an end face for abutment against a flange of the I-beam and further having, extending obliquely downwardly and outwardly from the upper edge of said end face, a bifurcated guide means arranged to extend over the upper portions of a flange of such an I-beam and to engage on either side of the central web of the I-beam.

Such an arrangement provides, in a simple manner, for both vertical and horizontal alignment of the end of a roofing truss during its attachment to the I-beam.

In accordance with a preferred feature of the invention there may also be provided clamping means for engagement around the flange of an I-beam and an end plate of the roofing truss, for clamping the latter securely against the I-beam, in use. Thus the requirement for the insertion of securing bolts through apertures in the flange of the I-beam and the end plate of the roofing truss may be avoided, further simplifying assembly of the roof.

Advantageously, the central web of the I-beam may be provided with angled counter pressure plates for face to face engagement with the bifurcated guide means of the roofing truss.

If desired additional security in the finished assembly may be obtained by securing bolts extending through the bifurcated guide means and the counter pressure plates of the I-beam.

Figure 4:
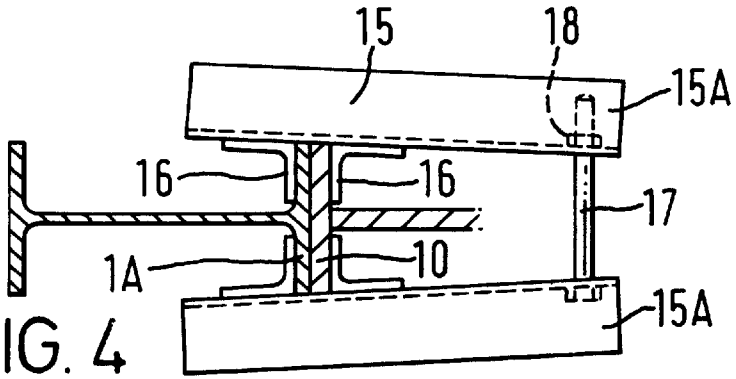
Figure 2:
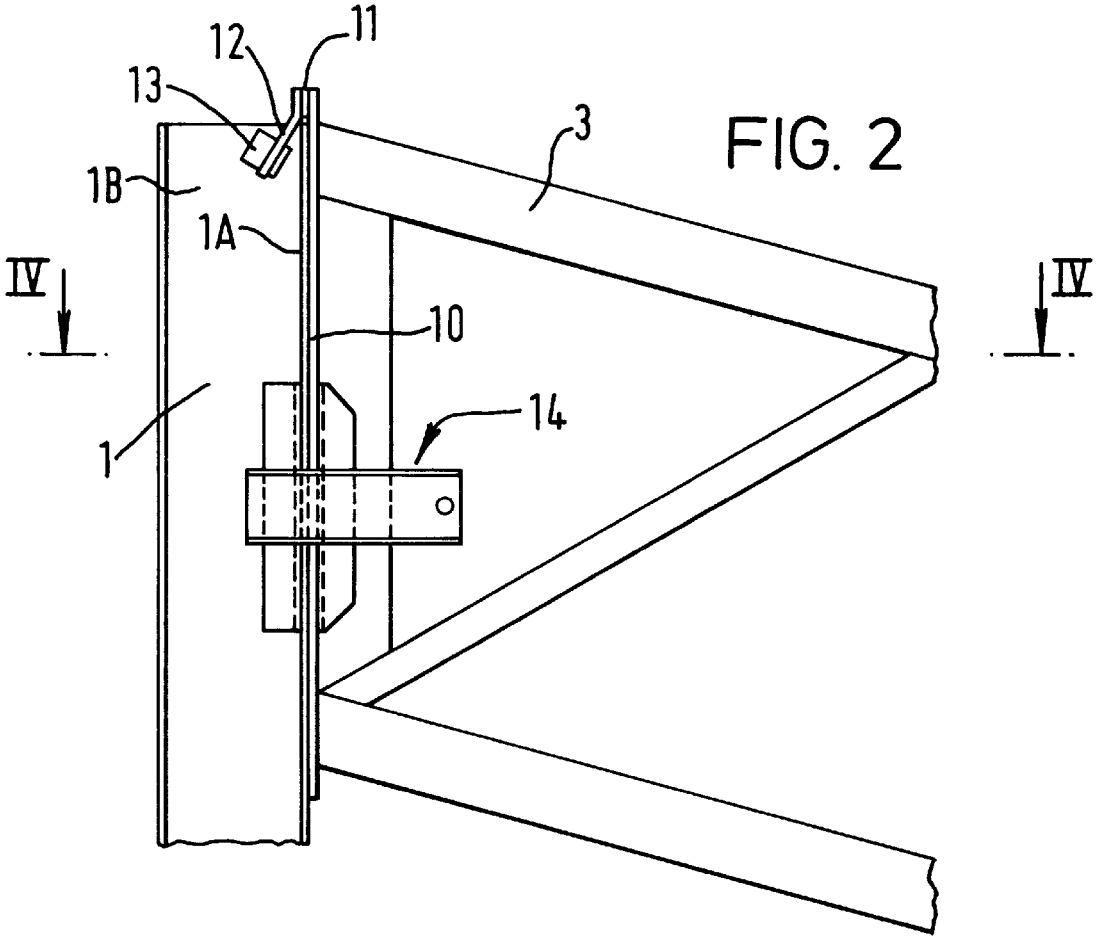
Figure 3:
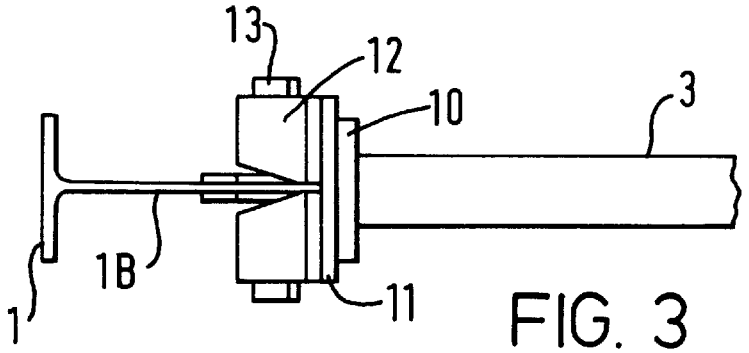
Figure 5:
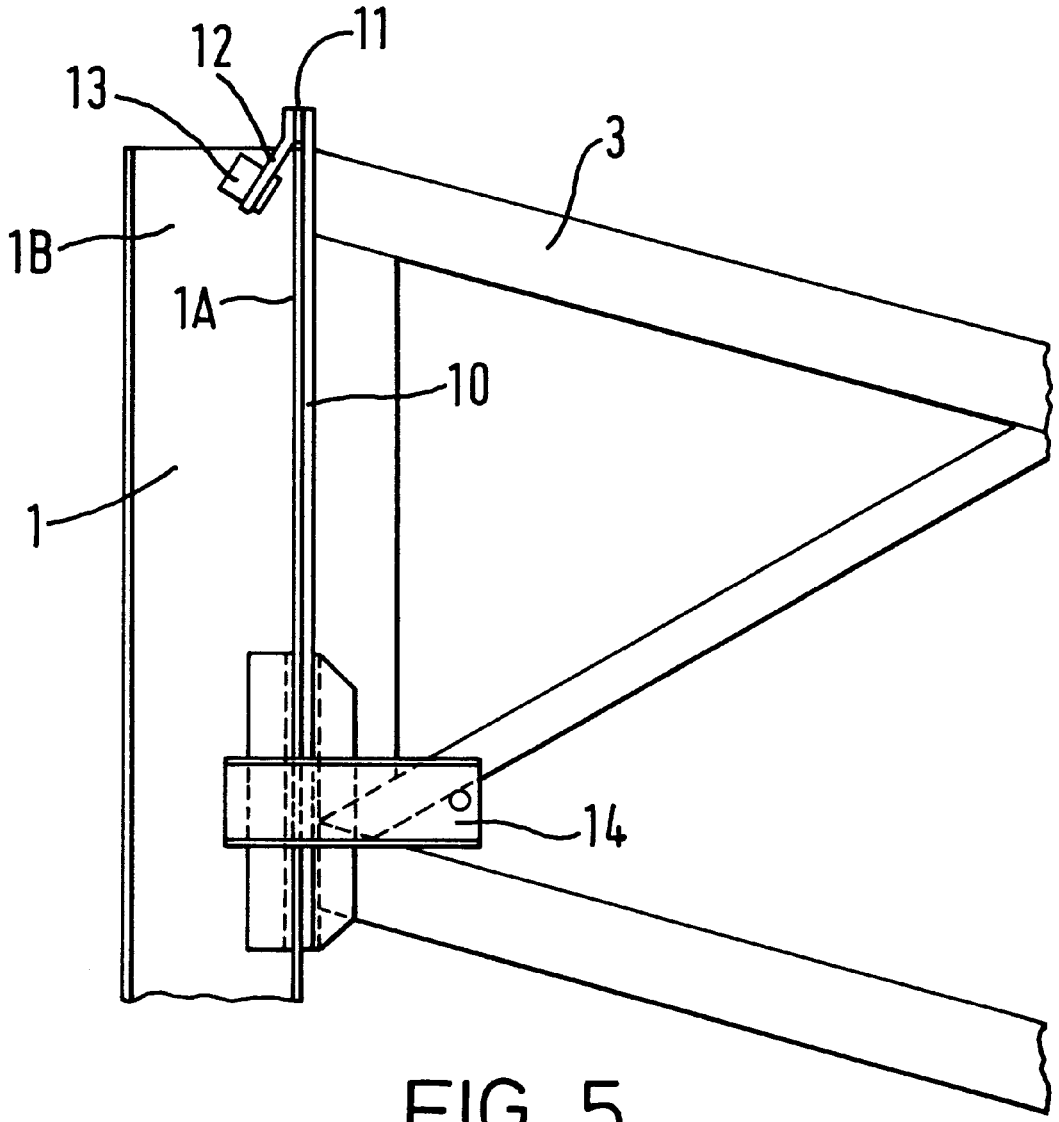

The invention is illustrated by way of example in the accompanying drawings, in which;

FIG. 1 is a diagrammatic elevation of part of a building construction of a kind to which the present invention may be applied, FIG. 2 is an enlarged detail of a part of a roofing construction of the kind shown in FIG. 1, FIG. 3 is a plan view corresponding to FIG. 2, FIG. 4 is a sectional plan view taken on the line IV—IV of 2, and FIG. 5 is a view similar to FIG. 2 showing an alternative arrangement.

Referring to FIG. 1 there is shown an example of a building construction for use in warehousing and storage.

The building comprises a plurality of vertical I-beams 1 that are supported from the floor 2 of the building and anchored to the foundations in known manner. The upper ends of the I-beams support transversely extending roofing trusses 3 fabricated from welded steel frames in known manner. Trusses 3 spanning the central area of the building may be interconnected by tension braces 4, and further trusses 3 may extend as cantilevers from the I-beams 1 to edges of the roof. The roof trusses 3 may support longitudinally extending purlins 5 that carry roof cladding 6 in known manner.

Such a construction has the advantage that it can provide open access to the storage area below the roof without the need for load-bearing walls. The vertical I-beams 1 may also carry cantilever racking arms 7 that are attached to the I-beams in known manner.

The detail of a connection made in accordance with one embodiment of the invention, between an I-beam 1 and a roof truss 3, is shown in FIGS. 2 and 4. Each roof truss includes a vertically extending abutment plate 10 as in integral part of its welded structure. At the upper end of the plate 10, there is welded a spacing plate 11 the thickness of which substantially corresponds to the thickness of a flange 1A of the I-beam. The spacing plate 11 in turn supports a pair of downwardly angled guide plates 12 that form a bifurcated guide arrangement extending over the central web 13 of the I-beam, as shown in more detail in FIG. 3.

The web 1B also supports a pair of L-shaped angle plates 13 that are welded obliquely to the web 1B, so that outwardly extending limbs thereof are parallel to the planes of the guide plates 12 and are in closely abutting relationship with the latter when the truss 3 is in the assembled position shown.

The end plate 10 of the truss 3 is held securely in abutting relationship to the flange 1A of the I-beam by a clamping means indicated generally by reference numeral 14 in FIG. 2, and which will be described in more detail with reference to FIG. 4.

A pair of arms 15 of U-shaped channel section each have welded thereto a pair of transverse members 16 of L-shaped angle section. The members 16 are accurately spaced so that opposed flanges thereof extend in parallel relationship at a spacing that corresponds to the combined thickness of the web 1A of the I-beam 1 and the end plate 10 of the truss 3. Ends 15A of the arms 15 are drawn towards one another by means of a clamping bolt 17, and the canting of the arms 15 that occurs as a clamping nut 18 is tightened onto the bolt 17, causes the angle members 16 to exert a wedging effect upon the abutting flange 1A and plate 10, so that the latter are clamped immovably into engagement with one another.

It will be seen that an arrangement in accordance with the above described embodiment of the invention provides an extremely simple and effective connecting assembly. When the roofing truss 3 is initially brought into engagement with the upper end of the I-beam 1, it is only necessary to hook the guide means 12 over of the I-beam to engage the flange 1A and the web 1B, and then to lower the truss 3 sufficiently that it settles into position with the end plate 10 in abutment with the web 1A, under its own weight, whilst remaining partly supported by any hoist. The clamping arms 15 are then assembled with angle members 16 on opposite sides of the flange 1A and the end plate 10, and the clamping bolt 17 is passed through ends 15A of the arms 15 and secured by the clamping nut 18 to complete the assembly.

If desired additional security can be provided by inserting connecting bolts through the plates 12 and 13.

Whilst such an arrangement is not necessary in normal use, it may provide additional security under extreme weather conditions when wind exerts an upward lifting force upon the roof and the trusses 3.

As shown in FIG. 5, additional security of the connection between the truss 3 and the I-beam 1 may be obtained by positioning the clamping means 14 towards the lower edge of the plate 10. This requires that the angle members 16 facing the plate 10 be profiled or notched to fit around the lower longitudinal beam of the roofing truss 3.

Although the plates 10, 11, 12 and the plates 13 are welded in place in the above arrangement, it will be appreciated that these elements could alternatively be secured by other means such as nuts and bolts.

Also although the roofing truss 3 shown in the drawings is formed in conventional manner by steel beams and struts of rectangular box section it would also be possible to fabricate the trusses from angle section, also in generally known manner.

What is claimed is:

1. A roofing truss for assembly to the upper end of a vertical I-beam, the truss comprising an end face for abutment against a flange of the I-beam and further having, extending obliquely downwardly and outwardly from the upper edge of said end face, a bifurcated guide means arranged to extend over the upper portions of a flange of such an I-beam and to engage on either side of the central web of the I-beam.

2. A roofing truss as claimed in claim 1, in combination with a clamping means for engagement around the flange of an I-beam and an end plate of the roofing truss, for clamping the latter securely against the I-beam in use.

3. An assembly comprising a roofing truss as claimed in claim 1 and an upright I-beam for supporting the same, in which the central web of the I-beam is provided with angled counter pressure plates for face to face engagement with the bifurcated guide means of the roofing truss.

4. A roofing truss as claimed in claim 2, in which said clamping means comprises a pair of cantilever arms each having at one end a pair of spaced flanges extending parallel to one another for close fitting engagement against opposite faces of said end plate and said flange of said I-beam, and means for displacing and free ends of said cantilever arms relatively to one another to cause the spaced flanges to exert a clamping effect upon the said end plate and said flange.

5. A truss or assembly as claimed in claim 4 in which one of each of said pair of flanges is profiled or notched to fit around a beam of the roofing trust at a junction thereof with said end plate.

* * * * *